US011219283B2

(12) United States Patent
Bird

(10) Patent No.: US 11,219,283 B2
(45) Date of Patent: Jan. 11, 2022

(54) CONJOINING ASSEMBLY

(71) Applicant: Bradford M. Bird, Sunrise, FL (US)

(72) Inventor: Bradford M. Bird, Sunrise, FL (US)

( * ) Notice: Subject to any disclaimer, the term of this patent is extended or adjusted under 35 U.S.C. 154(b) by 0 days.

(21) Appl. No.: 17/180,051

(22) Filed: Feb. 19, 2021

(65) Prior Publication Data

US 2021/0315327 A1 Oct. 14, 2021

Related U.S. Application Data

(60) Provisional application No. 63/009,739, filed on Apr. 14, 2020.

(51) Int. Cl.
*A44B 17/00* (2006.01)

(52) U.S. Cl.
CPC ..... *A44B 17/0023* (2013.01); *A44B 17/0052* (2013.01)

(58) Field of Classification Search
CPC ..... A44B 17/0023; A44B 17/0052
See application file for complete search history.

(56) References Cited

U.S. PATENT DOCUMENTS 506,110 A 10/1893 Hampel
991,156 A 5/1911 Kerngood
1,452,052 A 4/1923 Nalle
1,589,158 A 6/1926 Hedison
1,782,165 A 11/1930 Ford
1,831,295 A * 11/1931 Fenton ..... A44B 17/0052 24/621
1,873,370 A * 8/1932 Ford ..... A44B 17/0017 24/621
2,548,004 A 4/1951 Duefrene
2,838,821 A 6/1958 Shur
3,107,408 A * 10/1963 Huelsterottoj ..... F16B 17/008 24/621
3,145,388 A 8/1964 Carpinella
3,210,820 A 10/1965 Humiston
3,392,729 A 7/1968 Lenoir
3,396,436 A 8/1968 Daddona, Jr.
3,551,963 A 1/1971 Mosher, Jr. et al.
3,613,181 A * 10/1971 Taylor ..... A44B 17/0029 24/662
4,099,303 A 7/1978 Parera
4,539,735 A * 9/1985 Kasai ..... A44B 17/0029 24/621
4,562,624 A 1/1986 Kanzaka
(Continued)

FOREIGN PATENT DOCUMENTS

CN ZL2021301289912 8/2021

*Primary Examiner* — David M Upchurch
(74) *Attorney, Agent, or Firm* — Malloy & Malloy, P.L.

(57) ABSTRACT

A conjoining assembly for removably connecting a plurality of items such as, but not limited to clothing articles, to one another including at least two securing members removably attachable to one another. Each securing member includes a base and a retainer structured for connection to one another concurrent to the base and retainer of each securing member cooperatively disposed in retaining relation to a different one of the plurality of items. The removable connection of the securing members may include a snap-action connection between the bases, without the use of conventional or customized tools, concurrent to retention of the different ones of the plurality of items.

11 Claims, 4 Drawing Sheets

(56) References Cited

U.S. PATENT DOCUMENTS

| | | | | |
|---|---|---|---|---|
| D301,567 | S | 6/1989 | Burke | |
| 5,038,413 | A | 8/1991 | Ursino | |
| 5,285,557 | A | 2/1994 | Schriever | |
| 5,490,309 | A | 2/1996 | Velasquez et al. | |
| 5,636,427 | A | 6/1997 | Lyle | |
| 5,926,925 | A * | 7/1999 | Hicks | A41B 11/002 24/303 |
| 5,933,929 | A * | 8/1999 | Kawakami | A44B 17/0035 24/681 |
| 5,974,590 | A | 11/1999 | Stubbs | |
| 6,006,423 | A | 12/1999 | Schriever | |
| 6,076,240 | A * | 6/2000 | Henzler | A44B 17/0011 24/661 |
| 6,092,241 | A | 7/2000 | Belllet | |
| 6,185,751 | B1 | 2/2001 | Mason | |
| 6,584,655 | B1 | 7/2003 | Cardwell, III et al. | |
| 7,058,986 | B2 * | 6/2006 | Pietzyk-Hardy | A41B 11/002 2/239 |
| D664,891 | S | 8/2012 | Takeda | |
| D665,304 | S | 8/2012 | Takeda | |
| 8,359,671 | B1 * | 1/2013 | Glass | D06F 95/008 2/239 |
| 8,683,660 | B2 * | 4/2014 | Hasegawa | A44B 17/007 24/114.05 |
| 9,839,263 | B2 * | 12/2017 | Villa | A44B 17/007 |
| D817,810 | S | 5/2018 | Chen | |
| D818,393 | S | 5/2018 | Chen | |
| D844,486 | S | 4/2019 | Hayashi et al. | |
| 10,278,457 | B2 * | 5/2019 | Hayashi | A44B 17/00 |
| D884,552 | S | 5/2020 | Chen | |
| 2006/0123606 | A1 | 6/2006 | Juan | |
| 2007/0256280 | A1 | 11/2007 | Azan | |
| 2013/0302558 | A1 | 11/2013 | Schoenbeck et al. | |
| 2019/0075892 | A1 | 3/2019 | Linn | |

* cited by examiner

CONJOINING ASSEMBLY

CLAIM OF PRIORITY

The present application claims priority under 35 U.S.C. Section 119, U.S. Provisional application having Ser. No. 63/009,739 and filed on Apr. 14, 2020 which is incorporated by reference herein in its entirety.

BACKGROUND OF THE INVENTION

Field of the Invention

The present invention is directed to a conjoining assembly comprising cooperatively structured securing members each structured for a "double snap" assembly and attachment to one another while retaining different garments or other articles intended to be conjoined, without the use of conventional or customized tools.

Description of the Related Art

The problem of "matching" garments or other clothing articles such as, but not limited to, socks, hosiery, etc. is well known. While generally considered to be a domestic problem, matching and removably attaching numerous articles, items, etc. are also prevalent in the commercial area. In more specific terms, the matching of pairs of socks or other garments, specifically during and after laundering and subsequent storage is commonly recognized as a tedious and time-consuming procedure. This is due at least in part to the fact that many such garments have somewhat similar but distinguishable structural and/or decorative features.

Numerous methods and devices have been proposed for mating garments which typically involve detachable connecting devices. Such approach requires a number of the devices be stored in a ready for use area so as to be applied whenever socks or other garments are removed and stored prior and subsequent to washing. Care must also be taken when the garments are worn to the extent that many connecting devices are detachable and must be stored and made available in a proper location. In everyday use, adequate storage locations are not available as socks and other garments may be worn by an individual in a variety of locations throughout a household.

Attempts to solve problems of the type set forth herein also include various types of clips, pins and other fasteners structures and devices that hold garments or other articles together while being washed. It is recognized that approaches and/or procedures involved in keeping articles or items together preferably include a mechanism or system that can be employed immediately after the articles intended to be conjoined, are no longer being worn or used. However, such techniques and devices may have the disadvantages of not being readily available after the garment has been worn or the article or device has been used.

Further by way of nonlimiting example, fastening devices, made of various materials may be structurally fragile, frequently resulting in a relatively short operable life. Also, many connecting devices are structured to be attached to the articles or devices intended to be connected in an ineffective manner, resulting in their detachment and thereafter becoming displaced and/or lost. Also, known or conventional connecting structures of the type referred to herein frequently require the use of tools, instruments, etc. for the attachment thereof to the articles or devices intended to be connected.

Accordingly, there is a need in this area for a conjoining assembly efficiently and effectively structured to be manually applied/attached to the articles or items intended to be conjoined. Further, such a preferred conjoining assembly should comprise a plurality of at least two securing members, each attached in retaining relation to a different article or item which are to be connected to one another. As such, the structural and operative features of the cooperatively configured securing members facilitate operative attachment to one another "manually" without the required use of a tool, instrument or other device.

Such an improved conjoining assembly would therefore have cooperative structuring of the at least two securing members as well as the components of which each of the two securing members are comprised, to enable assembly and operative retention utilizing a "double-snap" action connection and/or attachment. Moreover, such double-snap connection and/or attachment can be accomplished by the various components of each securing member being attached to one another, as intended, utilizing a manual, snap-action securement. Similarly, subsequent to each of the securing members being assembled in retaining relation to different articles or items, the two securing members may be manually attached in and operative position relative to one another also using a manual, snap-action securement.

It is also emphasized that the structural and operative versatility the conjoining assembly of the present invention facilitates the removable connection of articles, items, etc. which include, but are not limited to, matching articles of clothing or different portions of the same garment to one another. In the latter category a plurality of conjoining assemblies, each comprising at least two securing members may be used to attach different portions of a shirt, blouse, pants, etc. to one another in an effective and reliable manner.

SUMMARY OF THE INVENTION

The present invention is directed to a conjoining assembly structured to removably connect a plurality of at least two articles or items to one another. As should be evident from the structural and operative features of the conjoining assembly of the present invention as hereinafter described, the articles or items to be removably connected to one another may vary such as, but not limited to, articles of clothing comprised of different portions, such as a pair of socks or stockings. In the alternative, the article of clothing could be a shirt, blouse, pants, etc. wherein different portions of the same garment may be considered "different articles" being removably connected to one another.

However, it is emphasized that the articles or items which may be removably connected to one another utilizing the subject conjoining assembly are not limited to garments or articles of clothing. The versatility of the conjoining assembly is evident by it being operable for removable connection or attachment of a variety of different articles, items, devices, etc. to one another with little or no structural or operative modification to the conjoining assembly itself.

At least one embodiment of the conjoining assembly includes a plurality of at least two securing members each structured for attachment to a different one of the plurality of articles, items, etc. to be conjoined. Each of said at least two securing members comprises a base and a retainer, wherein each retainer of a common one of said securing members is connected to a corresponding base in retaining relation to a different one of the plurality of articles. Further, the bases of the at least two securing members are structured to facilitate removable attachment to one another concurrent to retaining relation or engagement with different ones of the plurality of articles or items being conjoined.

Moreover, each of said retainers is manually connected to a base of a common one of said securing members. As used herein, the term "manually connected" and "manual connection" and/or the equivalent thereof is meant to describe a connection or attachment of the retainer and the base of a common securing member by a force exerted by hand, without the use of conventional or customized tools or other externally applied devices. Similarly, the bases of different ones of the securing members to be connected together are cooperatively structured to be connected, by the application of manual force, without the use of external tools, instruments, connecting devices, etc.

Uniquely complementary structural and operative features of each of the securing members is the cooperative structuring of the retainer and base of each securing member which enables the connection thereof by a snap-action attachment. Similarly, the bases of different ones of the securing members to be conjoined are cooperatively structured to be removably connected to one another by a snap-action connection. Such a "double snap-action" capability further facilitates the manual connection, as described and at least partially defined above, between corresponding ones of the retainer and base of a common securing member as well as the removable manual connection of the bases of different ones of the securing members, to one another.

In more specific terms, a connecting segment or portion is formed on each base of each of the securing members. The connecting segments or portions on bases which are to be removably attached to one another define a connecting assembly structured to define the aforementioned manual, snap-action connection therebetween, as well as a removable connection from one another. As should be apparent, such removable connection facilitates separation of the bases of connected ones of the securing members and the separation of the garments or other items, which are conjoined. Further, while structural and operative features of the bases of different ones of the securing member may be similar or at least partially equivalent, the connecting segments may differ, but be cooperatively structured to facilitate the aforementioned manual, snap-action, removable attachment therebetween. Therefore, as explained in greater detail hereinafter the different bases of two securing members intended to be removably attached to one another may include their respective connecting segments having a male configuration and a female configuration. As such, the respective male and female configurations are each cooperatively dimensioned and structured to accommodate and facilitate the manual, snap-action removable attachment of the corresponding securing members to one another.

Somewhat similarly, the retainer and the base of a common securing member are structured to collectively define an attachment assembly structured to accomplish and facilitate the manual, snap-action attachment therebetween. As noted herein, each of the bases of the two or more securing members include at least partially equivalent structuring. As a result, the versatility of the conjoining assembly of the present invention is significantly enhanced by facilitating the attachment of any one of a plurality of retainers to any one of a plurality of different bases, to at least partially define different securing members. Therefore, as will also be described in greater detail hereinafter, the attachment assembly associated with each of the securing members includes the retainer having an attachment finger, which may be at least partially elongated, secured to and extending outwardly from an inner surface of a head portion of the same retainer. In cooperation therewith, the attachment assembly includes the corresponding base having an apertured construction including at least one aperture formed therein. The aperture is directly associated with a locking member which extends along an at least partially defines a periphery or peripheral portion, surrounding and defining the boundaries of the aperture. The flexibility of the locking member at least partially defines a biased structure, wherein locking member is normally biased into a "closed" or "collapsed" orientation, while still at least partially surrounding and defining the peripheral boundaries of the aperture.

Accordingly, the aforementioned manual, snap-action attachment between the retainer and the corresponding base, of a common securing member, comprises the attachment finger extending at least partially through the aperture of the base. Further, the distal end of the attachment finger may be somewhat enlarged. As such, the distal end may include a diameter or other appropriate transverse dimension which is larger than the diameter or corresponding transverse dimension of the aperture of the base, when the locking member is in the aforementioned closed orientation. Accordingly, the locking member is at least partially forced outwardly into an "open" or "expanded" orientation, concurrent to passage of the enlarged distal end of the attachment finger therethrough. Such open or expanded orientation of the locking member occurs when the enlarged distal end of the attachment finger movably engages the locking member forcing it outwardly into the aforementioned open or expanded orientation.

However, a portion of the length of the attachment finger adjacent or contiguous to the distal end may have a smaller transverse dimension than that of the distal end and be in the form of a recessed, undercut portion or area. Therefore, once attachment finger is operatively positioned such that the distal end has passed through the aperture, the flexible, biased construction of the locking member, will "snap-back" from its forced open or expanded orientation into an at least partially closed orientation in which it is normally biased. When so positioned, and outer periphery or peripheral portion of the locking member will be disposed in confronting, abutting relation to the recessed and/or undercut portion or area of the distal end. In turn, this will result in a fixed positioning or attachment of the attachment finger and distal end into and at least partially through the corresponding base.

As normally utilized, each of the at least two securing members includes the retainer being fixedly attached to the base in retaining relation to a different one of a plurality of articles or items to be conjoined. Such is accomplished by the penetration of the attachment finger through the retained article and through the aperture of the base, into connection with the locking member. It is to be further noted that the length or equivalent dimension of the attachment finger must be sufficient to allow the retained article to be disposed or "sandwiched" between and inner surface of the retainer and a corresponding surface or face of the base. Thereafter, the two bases of the two securing members are brought into the aforementioned removable connection, thereby accomplishing the removable, conjoining relation of different ones of the plurality of articles or items.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

The invention now will be described more fully hereinafter with reference to the accompanying drawings in which illustrative embodiments of the invention are shown. This invention may, however, be embodied in many different forms and should not be construed as limited to the embodiments set forth herein; rather, these embodiments are provided so that this disclosure will be thorough and complete and will fully convey the scope of the invention.

Figure 2:
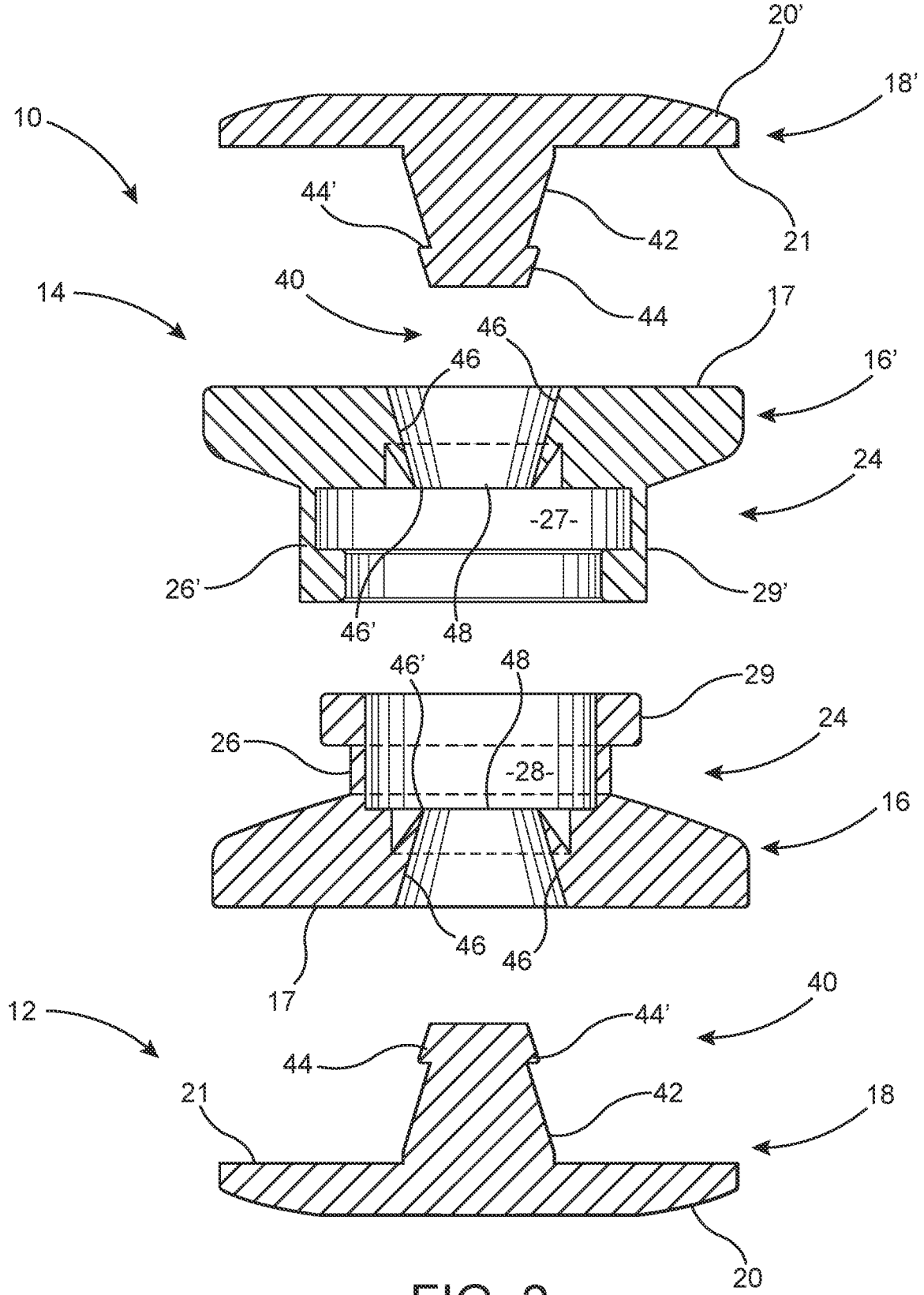
FIG. 2 is an exploded sectional view of the conjoining assembly of the embodiment of FIG. 1.

As represented, the conjoining assembly of the present invention is generally indicated as 10 and comprises a plurality of at least two securing members 12 and 14. As perhaps represented in greater detail in the exploded view of FIG. 2, each of the at least two securing members 12 and 14 include a base 16 and 16' and a retainer 18 and 18'. In addition, each of the retainers 18 and 18' include a head portion or member 20 and 20' which may be formed into a substantially disk-like configuration. In cooperation therewith, each base 16 and 16' is at least partially dimensioned and configured to facilitate attachment of the corresponding retainers 18 and 18' thereto.

Figure 1:
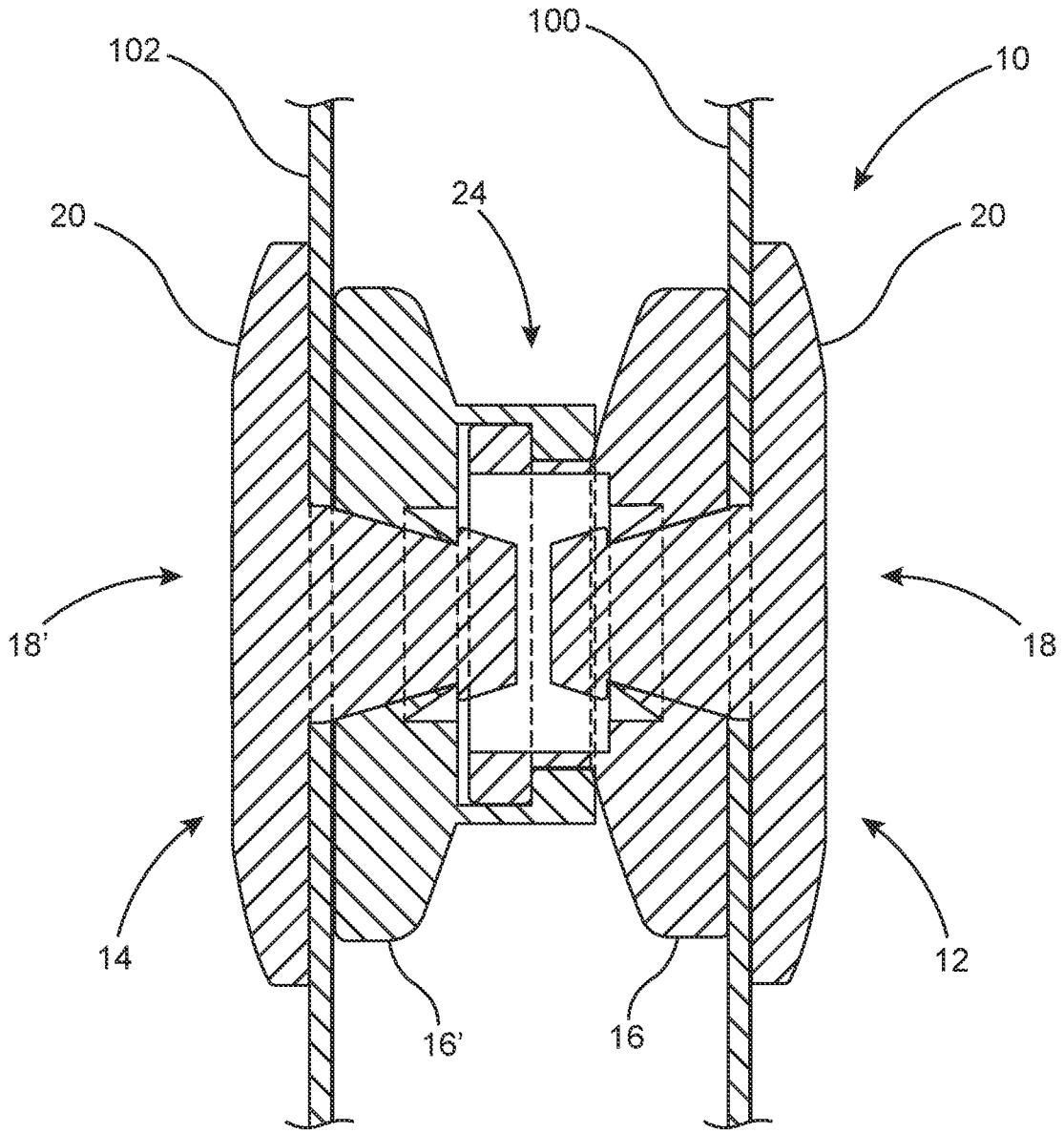
FIG. 1 is a sectional view of a conjoining assembly of the present invention represented in an attached, conjoining position.

As represented in the operative, conjoined and/or interconnected position of FIG. 1, each retainer 18, 18' is attached to a corresponding one of the bases 16, 16' prior to (FIG. 3) and concurrent to (FIGS. 1 and 4) the bases 16 and 16' being connected to one another. As will also be described in greater detail the operative, conjoined position of the at least two securing members 12 and 14 is accomplished concurrent to the retention of different articles, items, etc. 100 and 102.

As further emphasized herein, the articles or items 100 and 102 to be removably connected to one another may vary such as, but not limited to, articles of clothing comprised of different ones of a pair of socks, stockings, etc. However, in the alternative, the article of clothing could be a shirt, blouse, pants, etc. wherein different portions of the same garment may be considered "different articles" being removably connected to one another, such as when an individual "buttons-up" a shirt. It is further emphasized that the articles or items 100, 102 which may be removably connected to one another not be limited to garments or articles of clothing. The versatility of the conjoining assembly 10 of the present invention is evident by it being operable for removable connection or attachment of a variety of different articles, items, devices, etc. to one another with little or no structural or operative modification to the conjoining assembly 10.

Figure 3:
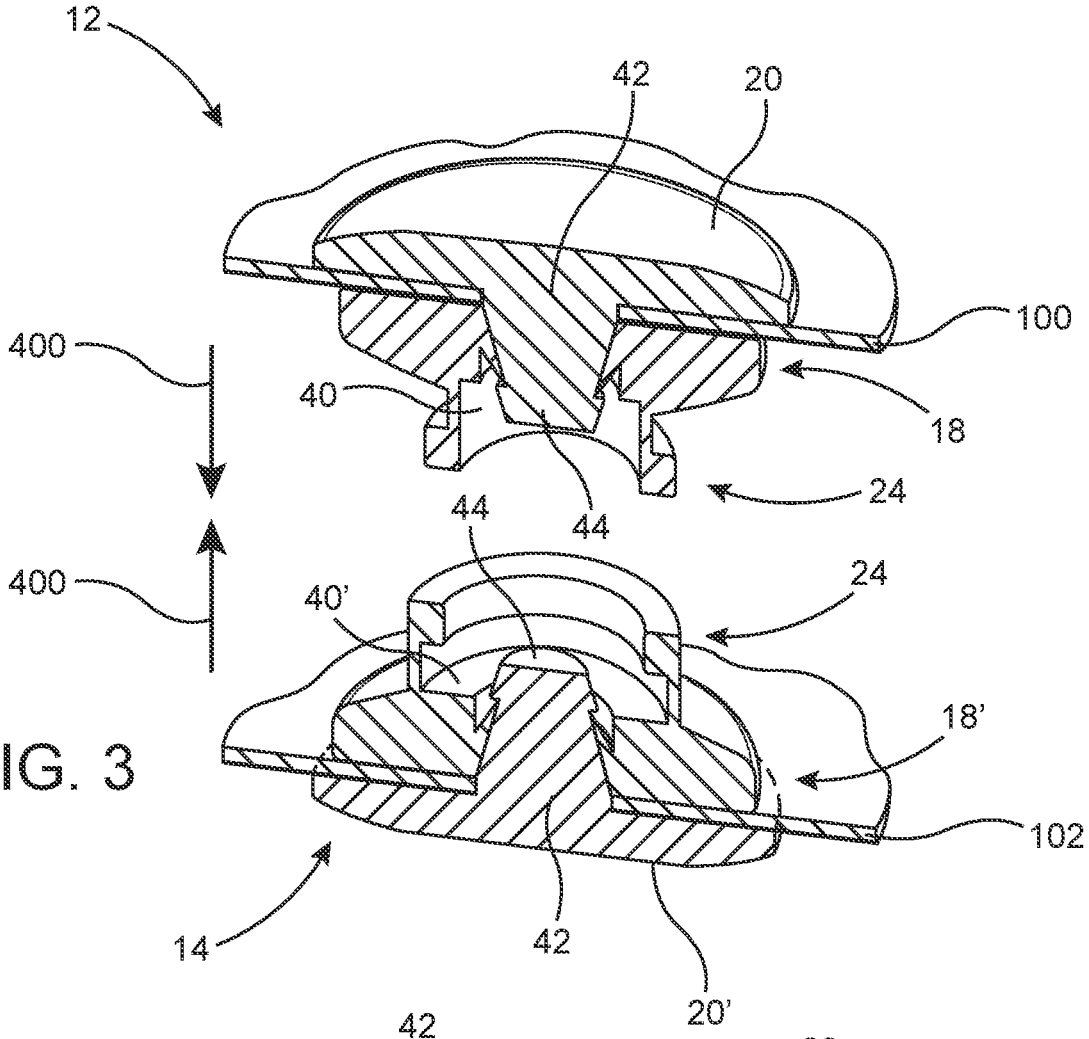
FIG. 3 is a perspective, exploded sectional view in partial cutaway of the embodiment of FIGS. 1 and 2.
Figure 4:
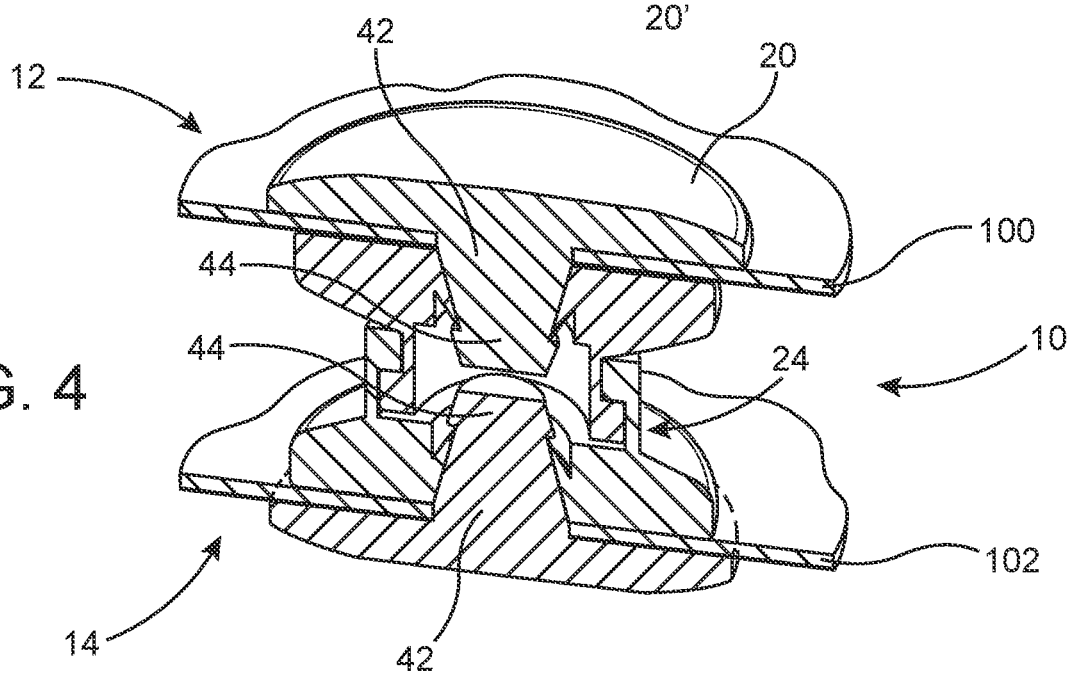
FIG. 4 is a perspective, sectional view in partial cutaway of the embodiments of FIGS. 1-3 in an operatively connected, conjoining orientation.

Therefore, in order to facilitate the effective and efficient removable conjoining of at least two articles 100, 102, each of the securing members 12 and 14 include a connecting assembly generally indicated as 24. Each connecting assembly including a connecting segment 26 or 26'. While the connecting segments 26 and 26' are cooperatively structured they are also cooperatively dimensioned and configured to facilitate a removable connection therebetween as represented in FIGS. 1, 3 and 4. Accordingly, the connecting segment 26 may be referred to as a male connecting segment and the connecting segment 26' may be cooperatively dimensioned and configured to define a female connecting segment. When operatively connected, as represented in FIGS. 1 and 4, the male connecting segment 26 is disposed at least partially within the interior 27 of the female connecting segment 26'. Further each of the connecting segments 26 and 26' include peripheral lips or ridges as at 29 and 29'.

In order to facilitate a firm, reliable but yet removable connection to one another the peripheral lip 29 is disposed exteriorly of the interior 28 of the male connecting segment 26 and is cooperatively disposed and dimensioned to be disposed in substantially abutting, confronting relation to the interior peripheral lip or flange 29', as represented in FIGS. 1 and 4. However the connection between the male connecting segment 26 and the female connecting segment 26' of the connecting assembly 24 is purposely intended to be removable such that the articles or devices 100 and 102 retained on the different securing members 12 and 14 may be separated for independent or cooperative use, as normally and practically applied. Such removable connection of the male and female connecting segments 26 and 26' is facilitated by at least one or both of the male connecting segment 26 and female connecting segment 26' being at least partially flexible, so as to be forced in an inwardly or outwardly collapsed and/or expanded orientation.

The result of such cooperative flexible structuring will facilitate male connecting segment 26 being manually forced into the interior 27 of the female connecting segment 26' to accomplish the removable operative conjoined attachment, as represented in FIGS. 1 and 4. Further, this described cooperative structuring and configuring between the connecting segments 26 and 26' provides for a snap-action removable connection therebetween due in part to the cooperative configurations of the peripheral lips or flanges 29 and 29' as well as the at least minimal flexibility of one or both of the male and female connecting segments 26 and 26'. As will be explained in greater detail with primary reference to FIG. 5, the removable, snap action connection between the bases 16 and 16' may be accomplished manually, thereby eliminating the need or necessity of any type of connecting tools, instruments, devices, etc.

In order to accomplish the intended operative, conjoined position of the at least two securing members 12 and 14, while independently retaining different articles or items 100 and 102, each of the securing members 12 and 14 include an attachment assembly generally indicated as 40 and 40' on different ones of the at least two securing members 12 and 14. In more specific terms, the attachment assembly 40 and 40' each comprise a attachment finger 42 formed on or connected to and extending outwardly from an inner surface 21 of the head or body 20 and 20' of each retainer 18,18'. Each attachment finger 42 may have an at least minimally elongated configuration such that when fixedly connected to a corresponding one of the bases 16 and/or 16' there is sufficient spacing between the inner surfaces 17 and 21, respectively of the bases 16 and 16' and the body 20 and 20' of the retainers 18,18'. As a result, different ones of a plurality of articles or devices 100 and 102 are retained in sandwiched relation therebetween.

Structural details of each attachment finger 42 also includes an enlarged distal end 44 cooperatively structured and dimensioned to accomplish a fixed, snap-action attachment with a locking member 46, also defining a portion of the connecting assembly 40 and 40'. The locking member 46 is formed of a flexible material and more specifically comprises a flexible, biased construction. In addition, each locking member 46 may have a continuous or closed annular configuration or in the alternative may have a segmented configuration, wherein either embodiment is disposed in at least partially surrounding relation to an aperture 48 formed in the base 16, 16'. The aperture 48 is disposed and dimensioned to receive passage of at least a portion of the attachment finger 42, specifically including the enlarged distal end 44. As represented, the locking member 46 extends along an at least partially defines a peripheral border of the aperture 48.

Therefore, the distal end 44 of each attachment fingers 42 has an enlarged diameter or other appropriate transverse dimension, which is greater than that of the "closed" or contracted orientation of the locking member 46 and/or aperture 48 when the locking member 46 is in the closed orientation. Accordingly, due to the flexible, biased structuring of the locking member 46, passage of the enlarged distal end 44 through the aperture 48 will force the locking member 46 outwardly into an "open" or expanded orientation (not shown for purposes of clarity) as the distal end 44 of each attachment finger 42 comes into movable engagement with interior portions of the corresponding locking member 46. As indicated the locking member 46 as a flexible, biased construction which serves to normally bias it into the closed orientation as represented in FIGS. 1 and 4. As a result, after the enlarged distal end 44 passes through the aperture 48 and beyond the locking member 46, the locking member 46 will "snap-back" into its normally biased position and into the closed orientation. As a result, the locking member 46 will lock and fixedly engage and maintain the distal end 44 of the corresponding attachment finger 42 into attachment with the corresponding base 16 and 16'.

The fixed, snap-action attachment between the attachment finger 42 and the locking member 46 is further facilitated by the relative, cooperative dimensioning and configuring therebetween. In more specific terms, the "enlarged" dimension of the distal end 44 can be defined as having a dimension or transverse dimension which is greater than that of the locking member 46 and aperture 48, when the locking member 46 is in its closed or contracted orientation as represented in FIGS. 1 and 4. Further, the locking member 46 includes an inwardly converging or slanted configuration as represented throughout the Figures. As such, when the locking member 46 "snaps-back" into the closed orientation, the outer peripheral portion thereof as at 46' is disposed into abutting, locking engagement with a recessed or undercut area 44' of the distal end 44. Therefore, the attachment between the attachment finger 42 and the corresponding locking member 46 can be accurately described as a snap-action attachment. Such a fixed, snap-action attachment may be accomplished by a manually applied force as will be explained in greater detail with reference to at least FIG. 5.

As also represented throughout the Figures, each of the retainers 16 and 16' are fixedly connected by the snap-action attachment to corresponding ones of the bases 18 and 18' after first disposing the respective attachment fingers 42 into and through the articles or devices 100 and 102 being retained. As also set forth herein, the retained articles or items 100 and 102 are effectively "sandwiched" between the inner surfaces 21 and 17 of the fixedly interconnected retainers 18, 18' and bases 16, 16'. Thereafter and as represented in at least FIGS. 3 and 4, the at least two securing members 12 and 14 are removably connected to one another by the aforementioned snap-action connection as the male connecting segment 26 passes into the interior 27 of the female connecting segment 26'. When so connected, it is noted that the enlarged distal ends 44 of the respective attachment fingers 42 are disposed in substantially aligned relation to one another as they are positioned within the interiors 27 and 28 of the female and male connecting segments 26' and 26 respectively.

Figure 5:
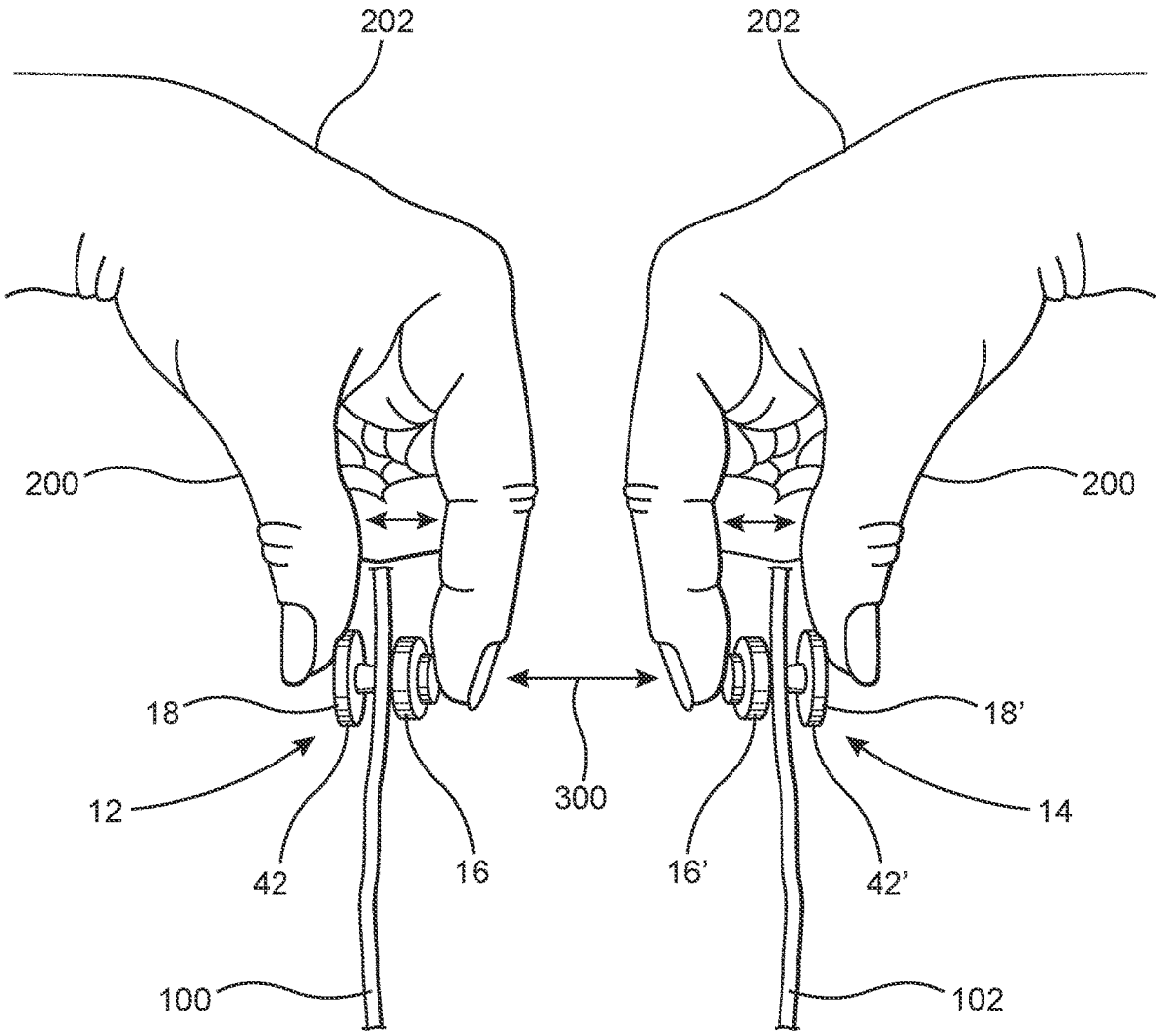
FIG. 5 is a combination view in perspective of different portions of the conjoining assembly of the present invention being manually attached to articles or other items to be conjoined.

With reference to FIG. 5 it is clearly represented that the fixed, snap action attachment between corresponding ones of the bases 16 and 16' and the retainers 18 and 18' and the removable snap-action connection between the bases 16 and 16' of conjoined ones of the at least two securing members 12 and 14 may be accomplished manually, without the use of tools, instruments or any type of connecting devices. More specifically, these manually applied-snap action connections and attachments may be accomplished by a user manipulating the fingers of one or both hands 200, to exert a squeezing, pushing, clamping, etc. force on corresponding ones of the bases 16, 16' and retainers 18, 18' of the different securing members 12 and 14. Such manually applied forces may be schematically indicated by directional arrow 300. This will result in the respective attachment fingers 42 penetrating through the respective articles or items 100 and 102 and the clamping and/or sandwiching of the articles 100 and 102 between the inner surfaces 17 and 21 respectively of the bases and retainers 16, 16' and 18, 18' of the at least two securing members 12 and 14.

Thereafter, removable, snap action connection of the bases 16,16' of the at least two securing members 12 and 14 is accomplished by exerting a manually applied squeezing, pushing, clamping, etc. force on each of the at least two securing members 12 and 14, as schematically indicated in FIG. 3 by directional arrows 400.

Therefore, uniquely advantageous structural and operative features of the conjoining assembly 10 is the ability to assemble the bases 16, 16' and the retainers 18 and 18' each of a plurality of at least two securing members 12 and 14, manually into the aforementioned snap-action attachment. Similarly, once assembled, each of the at least two securing members 12 and 14 can be removably and manually disposed into a snap-action connection, as demonstrated at least in FIG. 5. The conjoining assembly 10 of the present invention thereby enables a "double-snap" action assembly and securement of the at least two securing members 12 and 14 into the operative, conjoined position of at least FIGS. 1 and 4.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A conjoining assembly structured to removably connect a plurality of articles to one another, said conjoining assembly comprising:

at least two securing members each structured for attachment to a different one of the plurality of articles, each of said at least two securing members comprising a base and a retainer;

each of said retainers connected to a corresponding one of said bases in retaining relation to a different one of the plurality of articles, a connecting assembly disposed on said base of each of said at least two securing members; said connecting assembly structured to define a removable snap-action connection between said bases, said removable snap-action connection comprising said at least two securing members removably connected to one another concurrent to a retention of different ones of the plurality articles on each of said at least two securing members, an attachment assembly disposed on each of said at least two securing members and comprising an attachment finger and an aperture each formed on different ones of said retainer and said base, each of said at least two securing members comprising a locking member having a flexible construction and disposable into and out of a closed orientation and at least partially defining a peripheral boundary of a corresponding one said apertures;

said locking member disposed in said closed orientation, in fixed engagement with a distal end of a corresponding one of said attachment fingers, subsequent to passage of said distal end through said aperture, and said distal end of said attachment finger including a greater transverse dimension than that of said locking member, when said locking member is in said closed orientation.

2. The conjoining assembly as recited in claim 1 wherein said attachment assembly is structured to define a snap-action attachment of said base and said retainer of corresponding ones of said at least securing members to one another.

3. The conjoining assembly as recited in claim 1 further comprising said attachment assembly structured to define a manually applied connection of corresponding ones of said base and said retainer to one another, without the use of tools.

4. The conjoining assembly as recited in claim 3 wherein said attachment finger and said aperture cooperatively structured and dimensioned to define said snap-action attachment of said base and said retainer.

5. The conjoining assembly as recited in claim 1 wherein said retaining relation comprises said base and said retainer of a common one of said at least two securing members disposed in a substantially sandwiching relation to a retained one of the plurality of articles.

6. The conjoining assembly as recited in claim 1 wherein said connecting assembly comprises a male connecting segment and a female connecting segment each formed on a different one of said bases of said at least two securing members, said male and female connecting segments cooperatively dimensioned and configured to define a removable, manually applied, snap-action connection between said at least two securing members.

7. A conjoining assembly for removably connecting a plurality of articles to one another, said conjoining assembly comprising:

a plurality of at least two securing members each including a base and a retainer, a connecting assembly comprising each base of said at least two securing members including a different connecting segment formed thereon;

said different connecting segments cooperatively structured for removable snap-action connection of said at least two securing members, an attachment assembly disposed on each of said at least two securing members, each attachment assembly comprising an attachment finger having a distal end formed on said retainer and an aperture formed on said base, a flexible locking member disposed along and at least partially defining an outer peripheral boundary of said aperture and normally biased into and movable into and out of a closed orientation;

said flexible locking member movably and fixedly engaging said distal end, concurrent to passage of said attachment finger through said aperture of a common one of said at least two securing members; said distal end of said attachment finger including a greater transverse dimension than that of said locking member, when said locking member is in said closed orientation, and said removable snap-action connection comprising said at least two securing members removably connected to one another concurrent to a retaining relation of different ones of the plurality articles on each of said at least two securing members.

8. The conjoining assembly as recited in claim 7 wherein said locking member is disposed in said closed orientation in fixed engagement with said attachment finger subsequent to passage thereof through said aperture, said passage of said distal end at least partially defining a fixed, snap-action attachment of said retainer and said base of a common one of said at least two securing members.

9. The conjoining assembly as recited in claim 7 wherein said locking member comprises a periphery of said locking member biased in abutting engagement with a recessed, undercut portion of said distal end.

10. The conjoining assembly as recited in claim 7 wherein said retaining relation comprises said base and said retainer of a common one of said at least two securing members disposed in a substantially sandwiching relation to a retained one of the plurality of articles.

11. The conjoining assembly as recited in claim 7 wherein said connecting assembly comprises a male connecting segment and a female connecting segment each formed on a different one of said bases of said at least two securing members, said male and female connecting segments cooperatively dimensioned and configured to define a removable, manually applied, snap-action connection between said at least two securing members.

* * * * *